US008846162B2

(12) United States Patent
Sakurai et al.

(10) Patent No.: US 8,846,162 B2
(45) Date of Patent: Sep. 30, 2014

(54) MANUFACTURING METHOD FOR LIQUID-DISCHARGE HEAD SUBSTRATE

(75) Inventors: Makoto Sakurai, Kawasaki (JP); Ichiro Saito, Yokohama (JP); Takahiro Matsui, Yokohiro (JP); Yuzuru Ishida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 408 days.

(21) Appl. No.: 13/022,975

(22) Filed: Feb. 8, 2011

(65) Prior Publication Data

US 2011/0192498 A1 Aug. 11, 2011

(30) Foreign Application Priority Data

Feb. 9, 2010 (JP) ..... 2010-026488

(51) Int. Cl.
*B05D 5/12* (2006.01)
*H05H 1/00* (2006.01)
*H05H 1/24* (2006.01)

(52) U.S. Cl.
USPC ..... 427/539; 427/535; 427/533; 427/576; 427/100; 427/123; 427/125

(58) Field of Classification Search
USPC ..... 427/533, 534, 535, 539, 576, 100, 123, 427/125; 148/240, 241, 276, 277, 281
See application file for complete search history.

(56) References Cited

U.S. PATENT DOCUMENTS

| | | | | |
|---|---|---|---|---|
| 6,162,305 | A * | 12/2000 | Hsiao et al. | 148/280 |
| 6,265,318 | B1 * | 7/2001 | Hwang et al. | 438/720 |
| 6,398,349 | B1 * | 6/2002 | Murai | 347/68 |
| 6,893,978 | B1 * | 5/2005 | Kula | 438/765 |
| 7,195,343 | B2 * | 3/2007 | Anderson et al. | 347/63 |
| 2007/0146428 | A1 | 6/2007 | Sakai | |
| 2009/0315956 | A1 * | 12/2009 | Ishida et al. | 347/63 |

FOREIGN PATENT DOCUMENTS

| | | | |
|---|---|---|---|
| JP | 05177836 | A | 7/1993 |
| JP | 08183182 | A | 7/1996 |
| JP | 09048126 | A | 2/1997 |
| JP | 2001246753 | A | 9/2001 |
| JP | 2004146614 | A | 5/2004 |
| JP | 2007052311 | A | 3/2007 |
| JP | 2007-230127 | A | 9/2007 |
| JP | 2008105364 | A | 5/2008 |
| JP | 2008270380 | A | 11/2008 |

* cited by examiner

*Primary Examiner* — Michael Wieczorek
(74) *Attorney, Agent, or Firm* — Canon U.S.A., Inc., IP Division

(57) ABSTRACT

A manufacturing method for a liquid-discharge head substrate including a base material provided with an energy generating element that generates energy utilized for discharging liquid, a noble metal layer including noble metal provided on a surface of the base material on energy generating element side, and a material layer provided to come into contact with the noble metal layer. The manufacturing method includes preparing the base material on which the material layer is provided, oxidizing a part of a surface of the material layer by discharging electricity in oxygen-containing gas, and providing the noble metal layer on the base material.

9 Claims, 6 Drawing Sheets

MANUFACTURING METHOD FOR LIQUID-DISCHARGE HEAD SUBSTRATE

BACKGROUND OF THE INVENTION

1. Field of the Invention

The present invention relates to a substrate for liquid discharge head that discharges liquid such as ink, and a manufacturing method for a liquid discharge head.

2. Description of the Related Art

A head (inkjet head) used for an inkjet recording typically includes a plurality of discharge ports, a liquid flow path communicating with the discharge ports, and an electrothermal transducer that generates thermal energy used for discharging an ink.

In a heat-acting portion of an inkjet head (hereinafter, simply referred to as a head) that causes heat to act on the ink, a phenomenon may occur, in which a coloring material and additives and the like contained in the ink may be decomposed on the molecular level by heating at a high temperature and changed to a hard-dissoluble substance, and be physically adsorbed on an upper protective layer as a burnt deposit.

To solve the above-described problem, U.S. Patent Application Publication No. 2007/0146428 discusses a technique for removing the burnt deposit, by forming an upper protective layer containing metal such as iridium (Ir) or ruthenium (Ru) on a heat-acting portion that contacts the ink, applying a voltage onto the upper protective layer to perform an electrolytic reaction, thus dissolving the upper protective layer. Further, the upper protective layer is formed via a protective layer and an adhesive layer, and the adhesive layer is also used as a wiring when a voltage is applied onto the upper protective layer.

Japanese Patent Application Laid-Open No. 2007-230127 discusses a method for performing electrolytic reaction (electrolytic etching) using an electrolytic solution, in order to arrange Ir as a hard-etching material on the heat-acting portion.

However, the burnt deposit-removing operation may not possibly be uniformly performed at the adhesive layer, if wiring resistance varies. Further, in order to restrain reaction with the ink, and to enhance adhesiveness with a nozzle material, it is desirable that a surface of the adhesive layer be passivated. In order to achieve both, passivation of the surface of the adhesive layer by making the adhesive layer thick, or by the electrolytic reaction using the electrolytic solution may be useful. However, it is practically difficult to make the thickness of the upper protective layer and the adhesive layer formed on the heating resistor extremely thick, from viewpoint of transmission of heat energy to the ink. Further, it is difficult to cause the passivation by the electrolytic reaction using the electrolytic solution to uniformly react within a wafer plane. This is because, already-passivated area does not further react, and as a result, the voltage rises unevenly, and it is difficult to control the electrolytic reaction.

SUMMARY OF THE INVENTION

The present invention is directed to a manufacturing method for a liquid discharge head capable of providing with a high manufacturing yield a liquid-discharge head substrate in which the surface of an adhesive layer used for an upper protective layer is highly uniform and is passivated.

According to an aspect of the present invention, a manufacturing method for a liquid-discharge head substrate including a base material provided with an energy generating element that generates energy utilized for discharging liquid, a noble metal layer including a noble metal provided on a surface at an energy generating element side of the base material, and a material layer provided to come into contact with the noble metal layer, includes preparing the base material provided with the material layer including at least one of Ti, Ni, and Cr, or an alloy including at least one of Ti, Ni, and Cr, oxidizing a part of a surface of the material layer by discharging electricity in an oxygen-containing gas, and providing the noble metal layer on the base material.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
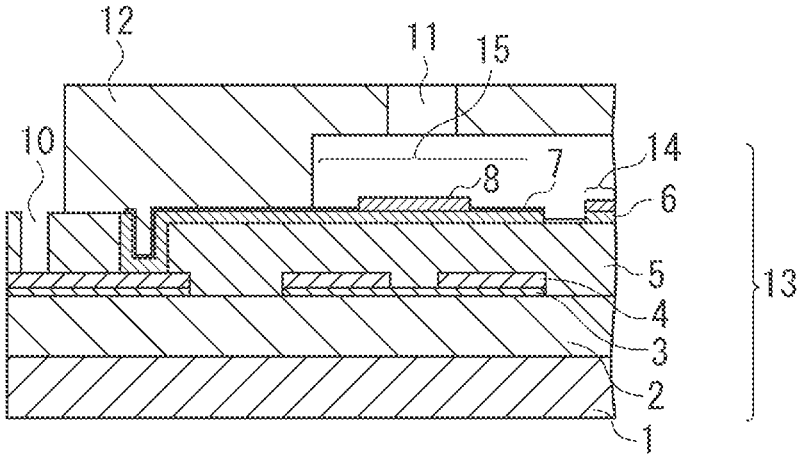
FIG. 1 is a schematic cross-sectional view of a liquid discharge head including a liquid-discharge head substrate to be manufactured according to an exemplary embodiment of the present invention.

FIG. 1 is a schematic cross-sectional diagram illustrating a configuration example of a liquid discharge head manufactured by a manufacturing method according to the present exemplary embodiment. In the exemplary embodiments described below, the present invention will be described taking an inkjet head as an example, but the present invention is not limited to this.

In FIG. 1, the liquid discharge head includes a silicon substrate 1, a heat accumulation layer 2 comprising an SiO film, an SiN film, or the like, a heating resistor layer 3, and an electrode wiring layer 4 serving as a wiring composed of metallic materials such as Al, Al—Si, Al—Cu. A heat-generating portion as an electrothermal transducer is formed by removing a portion of the electrode wiring layer 4 to form a gap, and exposing a part of the heating resistor layer 3 located at a position corresponding to the removed portion. In the heat-generating portion, heat as a discharge energy is generated.

The electrode wiring layer 4 is connected to a driver circuit or an external power supply terminal (not illustrated) via a through-hole 10 for an electrode, and can receive supply of an electric power from the outside. A protective layer 5 is provided on the electrode wiring layer 4, and comprises the SiO film, the SiN film or the like. An upper protective layer 8 protects the electrothermal transducer from chemical, physical impacts along with heat generation of a heat-acting portion, and is dissolved for removing burnt deposit when cleaning processing is performed.

An adhesive layer 6 is arranged between the protective layer 5 and the upper protective layer 8, enhances adhesiveness between the protective layer 5 and the upper protective layer 8, and functions as a wiring. An adhesive layer oxidized portion 7 is formed on the adhesive layer 6.

A feature according to aspects of the present invention lies in oxidizing the surface of the adhesive layer 6, the adhesive layer comprising at least one of Ti, Ta, Ni, and Cr, or comprising an alloy comprising at least one of Ti, Ta, Ni, and Cr, by discharging oxygen-containing gas. The oxygen gas is decomposed by inductively coupled plasma, and a dense and highly uniform oxide film can be formed by irradiating the surface of the adhesive layer with oxygen particles (e.g., ions or radicals) with a high energy.

At this time, it may be the case that the oxygen gas is more than 20% of a total volume in the gas. The oxide film can be formed according to one aspect by discharging electricity in the gas containing more than 20% of oxygen. As a result, the surface of the adhesive layer 6 can be passivated while suppressing variation of the wiring resistances. Therefore, since an applied voltage can be loaded stably and uniformly between liquid such as ink and the upper protective layer, the electrochemical reaction is stabilized, burnt deposit-removing operation can be implemented stably, and ink discharge reliability for a long period of time can be secured. Further, the surface of the adhesive layer can be passivated, while retaining adhesiveness with the flow path forming layer.

The adhesive layer 6 is formed using a material having electrical conductivity. Further, a thickness of the adhesive layer 6 is 50 to 200 nm, for example.

Figure 6:
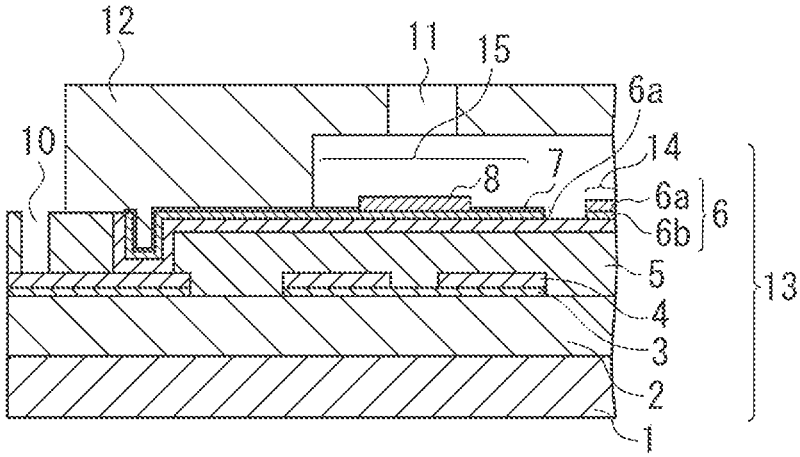
FIG. 6 is a cross-sectional view illustrating a part of processes of a manufacturing method for the liquid-discharge head substrate according to an exemplary embodiment of the present invention.

Further, the adhesive layer 6 can comprise a plurality of layers, and can be formed of, for example, 21 layers using different materials. According to one aspect, as illustrated in FIG. 6, in order to obtain more dense and uniform oxide film, the adhesive layer may be configured in such a manner that the upper adhesive layer 6*a* be made of Ti, and the lower adhesive layer 6*b* be made of Ta. In order to suppress variation of the wiring resistances, it may be the case that the film is formed in such a manner that the lower adhesive layer is thicker than the upper adhesive layer. According to one aspect, for example, the upper adhesive layer and the lower adhesive layer are selected from 50 to 150 nm and 5 to 50 nm, respectively.

An adhesive layer oxidized portion 7 is formed on the surface of the adhesive layer 6. In the present exemplary embodiment, the adhesive oxidized portion 7 can be formed using a reactive ion etching (RIE) apparatus, for example. The inductively coupled plasma (ICP) is used as a plasma source. For example, mixed gas of an argon gas (0 to 200 sccm) and an oxygen gas (1 to 100 sccm) can be used as a gas. As the condition, it is desirable to set a radio frequency (RF) power to 100 W to 2000 W (13.56 MHz), to adjust to contain oxygen gas that includes, for example, more than 20% of a total flow amount of all gases, and to set the pressure to a range from 0.1 to 50 Pa.

In the case where the upper adhesive layer 6*a* is made of Ti, and the lower adhesive layer 6*b* is made of Ta, for example, an adhesive force with a nozzle material can be increased by discharging oxygen-containing gas to oxidize the adhesive layer, thereby oxidizing the surface of the upper adhesive layer (Ti) to form a TiO layer.

The heat-acting portion in the inkjet head is exposed to a high temperature due to heat generation at the heating resistor, and is mainly subjected to cavitation impact or chemical action by the ink along with bubbling of the ink, and bubble contraction after the bubbling. For this reason, the protective layer 5 and the upper protective layer 8 are provided in order to protect the electrothermal transducer from the cavitation impact or the chemical action by the ink.

The upper protective layer 8 has the property of being dissolved into liquid such as ink by the electrochemical reaction, in addition to a function of protecting the electrothermal transducer from physical/chemical impacts. It is generally possible to recognize presence or absence of dissolution of metals by the electrochemical reaction, when you just look at a potential-pH diagram of various metals. From the viewpoint of having a dissolution region, and not forming a strong oxide film due to heating, as a material of the upper protective layer, it may be the case that an elemental substance of Ir or Ru, or alloys of Ir with other metals or alloys of Ru with other metals, are used. The higher the percentage of content of Ir or Ru, the more efficiently the electrochemical reaction advances. Consequently, respective elemental substances of metals may be provided. Even in the case of Ir alloys or Ru alloys, the effect according to aspects of the present invention can be obtained, and materials may be used that contain at least Ir or Ru.

Adhesiveness is enhanced by arranging the adhesive layer 6 between the upper protective layer 8 and the protective layer 5. The adhesive layer 6 is also used as a wiring when a voltage is applied for dissolving the upper protective layer 8, and accordingly it is made of an electrically conductive material.

In order to remove deposits on the upper protective layer located at the heat-acting portion, in the present exemplary embodiment, the electrochemical reaction that is generated between the upper protective layer 8 and liquid such as ink is utilized. For this reason, the through-hole 10 for an electrode is formed on the protective layer 5, and the upper protective layer 8 and the electrode wiring layer 4 are electrically connected via the adhesive layer 6. The electrode wiring layer 4 extends to the end of an inkjet head substrate, and its front-end is exposed to a bottom of the through-hole 10 for an external electrode in order to establish an electrical connection with the outside. The electrode wiring layer 4 is connected to the external electrode, and the upper protective layer 8 and the external electrode will be electrically connected to each other.

Moreover, in the present exemplary embodiment, the upper protective layer 8 is divided into two regions consisting of a region 15 including a portion formed in a position of the heat-acting portion formed above the heat-generating portion, and another region (region at facing electrode side) 14, and each electrical connection is effected in each region. The region 15 and the region 14 are not electrically connected to each other, if liquid such as ink does not exist within the liquid flow path. However, when a solution containing electrolyte is charged into the liquid flow path, electric current flows via the solution, and the electrochemical reaction is generated at an interface between the upper protective layer 8 and the solution. Since the ink used for the inkjet recording contains the electrolyte, and the upper protective layer contains Ir or Ru, it is possible to generate dissolution of Ir or Ru if the ink exists. At this time, since the dissolution of a metal occurs at an anode electrode side, a potential may be applied so that the region 15 is to be the anode side, and the region 14 to be the cathode side, in order to remove burnt deposit in the heat-acting portion.

Further, in the present exemplary embodiment, the upper protective layer is formed using Ir or Ru in the region 14 as well. But, if it is possible to implement an electrochemical reaction via the solution (e.g., an ink), the region 14 may be formed using other materials.

Moreover, although Ir or Ru is used as the upper protective layer 8, in the above-described configurations, other materials may be used as long as they contain metals dissolved by the electrochemical reaction, and do not form an oxide film which interferes with the dissolution by heating. Materials which do not form the oxide film which interferes with the dissolution by heating as described above, do not mean materials which never form the oxide film, but mean materials which, even if the oxide film is formed by heating, the oxide film is only formed to such a degree that it does not interfere with the dissolution. In the case of the Ir alloys or Ru alloys, the more the percentage of content of Ir or Ru, the more likely the degree to which the oxide film is formed, tends to decrease. Hence, it is desirable to select composition of a metal which constitutes the upper protective layer 8 depending on the above-described tendency and durability of desired metal.

A flow path forming member 12 is joined to the inkjet head substrate 13 according to the above-described configuration. The flow path forming member 12 has a discharge port 11 at a position corresponding to the heat-acting portion, and forms the liquid flow path communicating with the discharge port 11.

FIGS. 2 and 3 are cross-sectional process diagrams illustrating a manufacturing process of the inkjet head substrate according to a second exemplary embodiment.

Figure 2A:
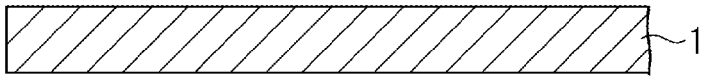
FIGS. 2A to 2E are cross-sectional process diagrams illustrating a manufacturing method of the liquid-discharge head substrate according to the exemplary embodiment of the present invention.

First, as illustrated in FIG. 2A, a silicon substrate is prepared. In the present exemplary embodiment, the case of the silicon substrate composed of Si will be described, and a drive circuit including a semiconductor device such as a switching transistor for selectively driving the heat-acting portion can be produced in advance on the silicon substrate 1.

Figure 2B:
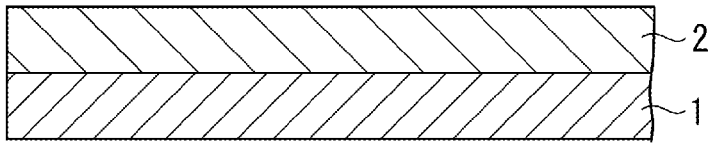

Next, as illustrated in FIG. 2B, the heat accumulation layer 2 is formed on the silicon substrate 1 by a thermally oxidizing method, a sputtering method, a chemical vapor deposition (CVD) method or the like. The heat accumulation layer 2 can be composed of the thermally oxide layer made of $SiO_2$, for example. The heat accumulation layer can be also formed during the process of forming the drive circuit.

Figure 2C:
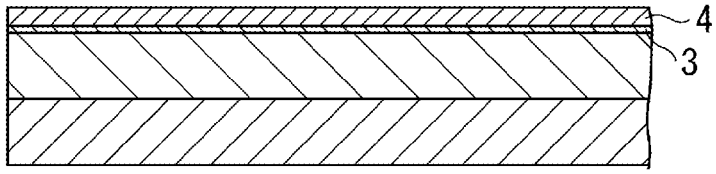

Next, as illustrated in FIG. 2C, the heating resistor layer 3 is formed on the heat accumulation layer 2. The heating resistor layer 3 can be formed to have a thickness of about 50 nm by a reaction sputtering of TaSiN, for example. Moreover, the electrode wiring layer 4 is formed on the heating resistor layer 3. The electrode wiring layer 4 can be formed to have a thickness of about 300 nm by the sputtering of Al, for example.

Figure 2D:
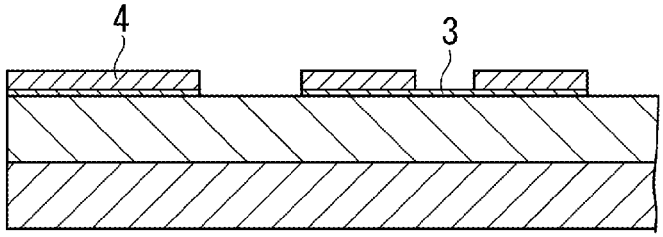

Next, as illustrated in FIG. 2D, dry etching is performed on the heating resistor layer 3 and the electrode wiring layer 4 at the same time, using a photolithography method, to form a wiring pattern. For example, a reactive ion etching (RIE) method can be used as a dry etching. Moreover, in order to form the heat-generating portion, the electrode wiring layer 4 made of Al is partially removed by performing wet-etching after patterning using the photolithography method again, to expose part of the heating resistor layer 3 located at a position corresponding to the removed part. In order to obtain a satisfactory coverage property of the protective layer 5 at the wiring ends, it is desirable to employ a known wet-etching technique, by which an appropriate tapered shape can be obtained at the wiring ends.

Figure 2E:
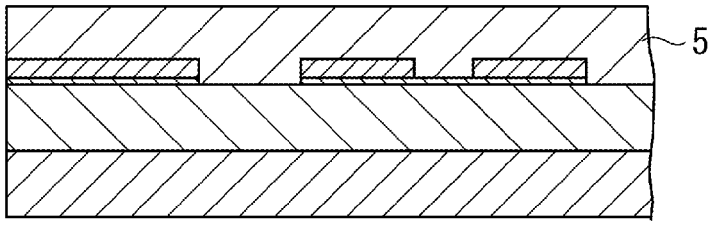

Subsequently, as illustrated in FIG. 2E, the protective layer 5 is formed on the heat accumulation layer 2, the heating resistor layer 3, and the electrode wiring layer 4. The SiN film can be formed to have a thickness of about 350 nm as the protective layer 5 using a plasma CVD method, for example.

Figure 3A:
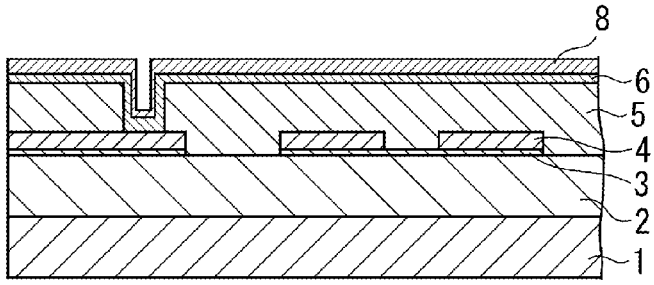
FIGS. 3A to 3E are cross-sectional process diagrams, continued from FIG. 2E, illustrating a manufacturing method of the liquid-discharge head substrate according to the exemplary embodiment of the present invention.

Next, as illustrated in FIG. 3A, the through-hole is formed on the protective layer 5. The through-hole can be formed using the dry etching, for example, until it reaches the electrode wiring layer 4. Also, as illustrated in FIG. 3A, the adhesive layer 6 is formed on the protective layer 5 where the through-hole is formed, and the upper protective layer 8 is formed on the adhesive layer 6. The adhesive layer 6 can be formed by Tantalum (Ta) to have a thickness of about 120 nm using the sputtering method, for example. As other example, The adhesive layer 6 can be formed by at least one of Ti, Ni, and Cr, or an alloy comprising at least one of Ta Ti, Ni, and Cr. Further, according to one aspect, Iridium (Ir) that constitutes the upper protective layer 8 can be formed to have a thickness of about 200 nm using the sputtering method, for example.

Figure 3B:
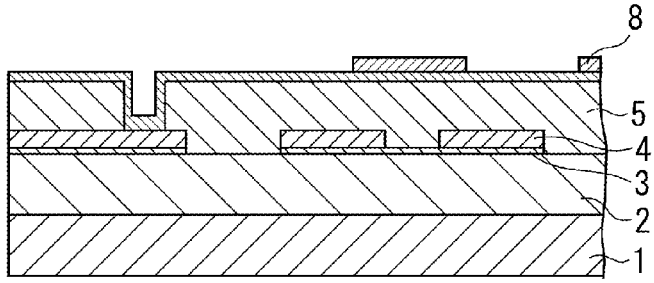

Next, as illustrated in FIG. 3B, the upper protective layer 8 is subjected to patterning to remain on at least the heat-acting portion and the region 14. At this time, using the adhesive layer 6 as an etching stop layer, the upper protective layer 8 can be patterned using the reactive ion etching (RIE) apparatus, for example. The reactive ion etching can be performed using the inductively coupled plasma (ICP) as a plasma source, for example, and under etching conditions: argon gas; 30 sccm, chlorine gas; 70 sccm, pressure; 0.3 Pa, discharge condition; 500 W (13.56 MHz).

According to one aspect, the reactive ion etching for patterning of the upper protective layer 8 may be performed using the inductively coupled plasma (ICP) as a plasma source, an argon gas (1 to 200 sccm), and a chlorine gas (1 to 200 sccm) as an etching gas, and in a range of an etching pressure of 0.1 to 10 Pa, an RF power of 100 to 2000 W (13.56 MHz).

Figure 3C:
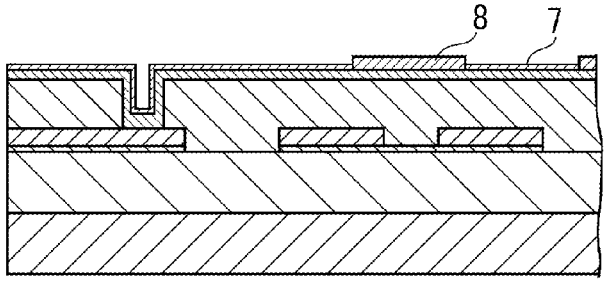

Next, as illustrated in FIG. 3C, the surface of the adhesive layer 6 is oxidized, and the adhesive layer oxidized portion 7 is formed. At this time, the adhesive layer is oxidized by discharging oxygen-containing gas. More specifically, the adhesive layer oxidized portion 7 can be formed using the reactive ion etching (RIE) apparatus, for example. The adhesive layer oxidized portion 7 can be formed using the inductively coupled plasma (ICP) as a plasma source, for example, and under the conditions of an argon gas; 200 sccm (0 to 200 sccm), an oxygen gas; 70 sccm (1 to 100 sccm), a pressure; 1.0 Pa (0.1 to 50 Pa), a discharge condition; 1000 W (100 to 2000 W) (13.56 MHz). The values in parentheses indicate ranges according to aspects of the invention.

Figure 3D:
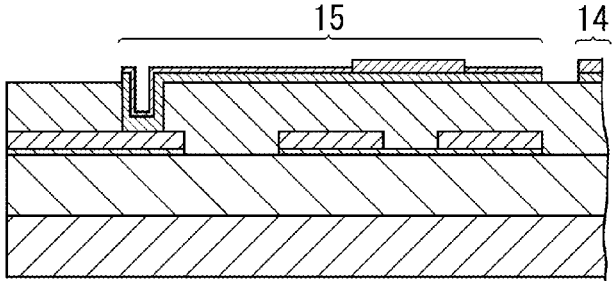

Next, as illustrated in FIG. 3D, patterning is performed using the photolithography method, in order to electrically separate the adhesive layer 6 and the adhesive layer oxidized portion 7 into the region 14 and the region 15. For example, the reactive ion etching (RIE) can be employed for the patterning.

Figure 3E:
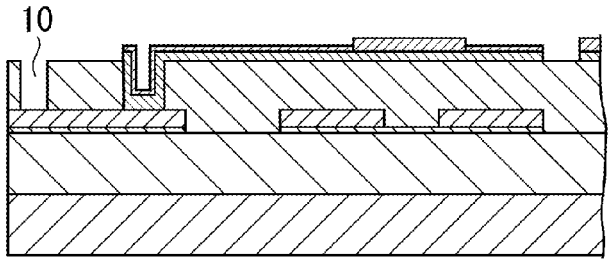

Next, as illustrated in FIG. 3E, in order to form the through-hole 10 for the external electrode, the protective layer 5 has been partially removed to expose part of the electrode wiring layer 4 located at a position corresponding to the removed part. The through-hole 10 for the external electrode can be formed using the dry etching, for example.

Next, the flow path forming member 12 is formed, and an discharge element provided with an discharge port 11 for discharging a liquid such as an ink is formed (see FIG. 1).

Figure 4:
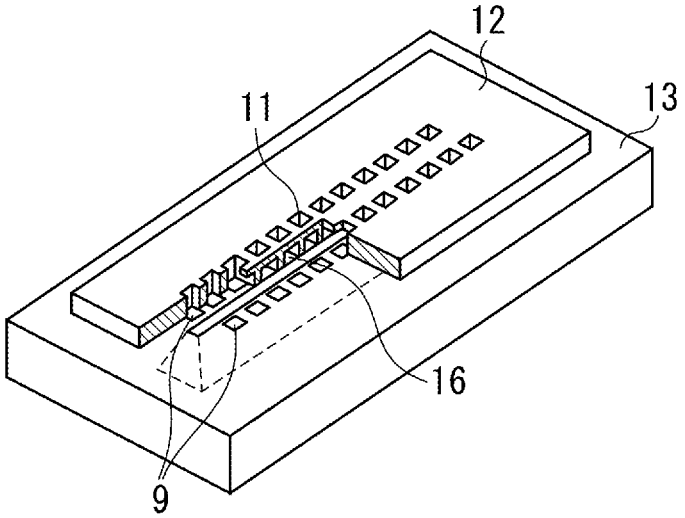
FIG. 4 is a schematic perspective view of an inkjet head manufactured with the manufacturing processes according to the exemplary embodiment of the present invention.

Finally, the ink supply ports 16 (see FIG. 4) are formed, and the substrate is cut and separated, and chipped with a dicing saw or the like. Then, electrical connection for driving the heating resistor and connection of the ink supply member are performed. Accordingly the inkjet head is completed.

A chip tank for supplying the ink to thus formed inkjet head was attached, and the inkjet recording head was produced. After surveying discharge characteristics, it was confirmed that there is no problem in recording quality.

[Evaluation of Inkjet Recording Head]

The evaluation was conducted using the inkjet recording head produced using a manufacturing method according to the present exemplary embodiment, and as comparison, the inkjet recording head having an adhesive layer which was passivated by the electrochemical reaction. Discharge evaluation was conducted by discharging an alkali ink (pH 10), at a drive frequency; 15 kHz, with a pulse width; 1 μs, and at a driving voltage; 24 V, and under burnt deposit-removing operation condition of 10V, 15 seconds for each 1×10^6 pulses. As a result, the inkjet recording head having the adhesive layer passivated by electrolytic reaction suffered defective discharge due to the burnt deposit in some nozzles, and degradation of print quality was confirmed. On the other hand, it was confirmed that there is no problem with recording quality in the inkjet recording head produced using a method according to the present exemplary embodiment.

Although the case of the adhesive layer composed of one layer has been described in the second exemplary embodiment, the adhesive layer can be also formed of two layers, as will be described in a third exemplary embodiment.

In other words, in the second exemplary embodiment, the adhesive layer 6 can be formed of two layers consisting of the lower adhesive layer and the upper adhesive layer. For example, Ta as the lower adhesive layer can be formed to have a thickness of about 100 nm, and Ti as the upper adhesive layer can be formed to have a thickness of about 15 nm.

On the upper adhesive layer, as the upper protective layer 8, for example, Ir can be formed to have a thickness of about 200 nm by sputtering. The upper protective layer 8 can be patterned similar to the second exemplary embodiment.

Thereafter, in the present exemplary embodiment, the upper adhesive layer can be oxidized to form the adhesive layer oxidized portion 7. More specifically, in order to oxidize the surface of the upper adhesive layer to form the adhesive layer oxidized portion 7, the reactive ion etching (RIE) apparatus, for example, can be employed. The inductively coupled plasma (ICP) as a plasma source is employed for formation of the adhesive layer oxidized portion 7, and the conditions can be set to, for example, an argon gas; 200 sccm, an oxygen gas; 70 sccm, a pressure; 1.0 Pa, and discharge condition 1000 W (13.56 MHz).

Figure 5:
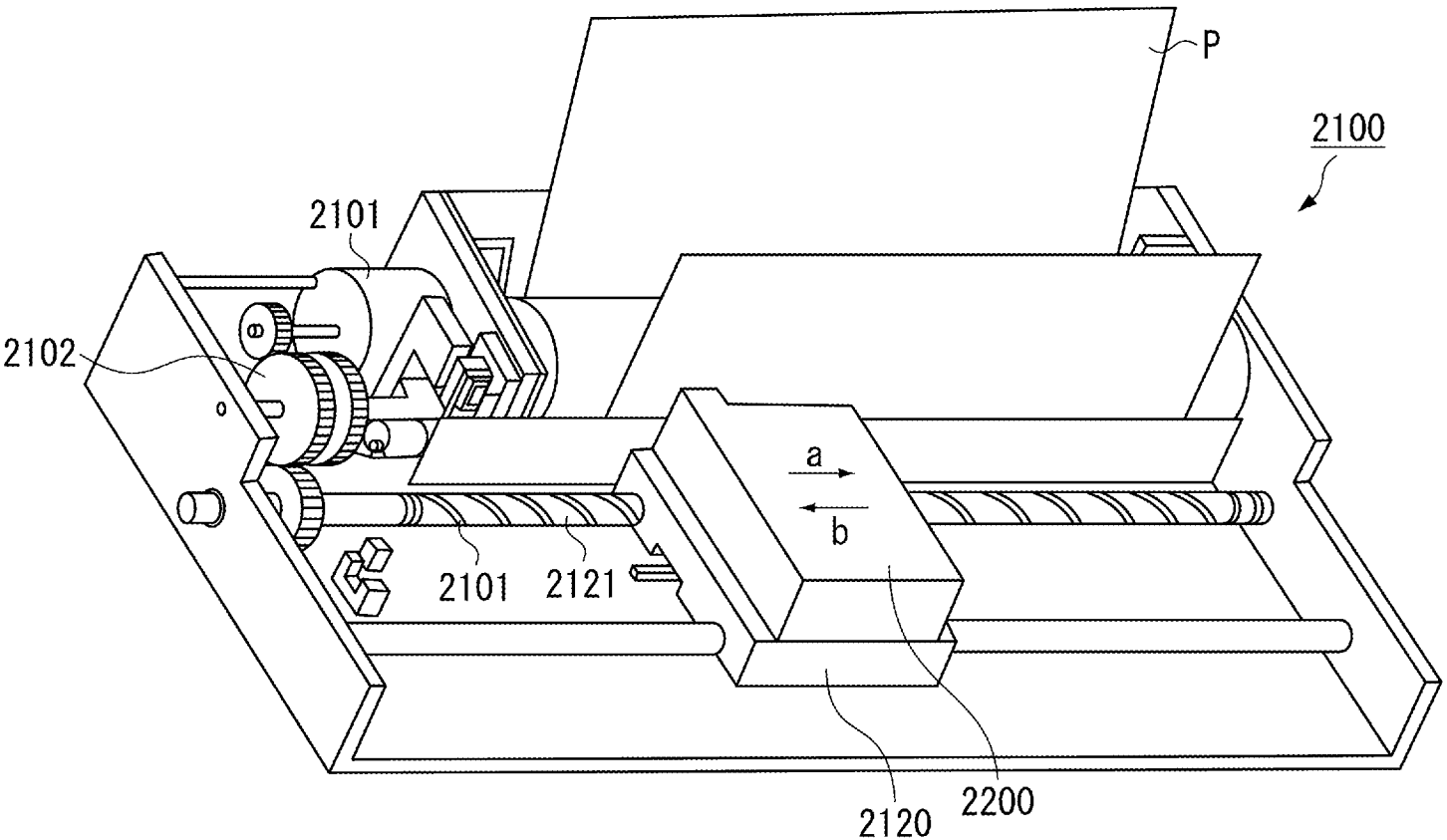
FIG. 5 is a perspective view illustrating a schematic configuration example of an inkjet recording apparatus that performs recording using the inkjet head.

FIG. 5 is an outer appearance view of an example of the ink jet apparatus to which the inkjet head produced using a manufacturing method according to the present invention is applied.

In an ink jet apparatus 2100 illustrated in FIG. 5, a recording head 2200 including the inkjet head produced using the manufacturing method according to the present invention is mounted on a carriage 2120 which engages with a spiral groove 2121 of a lead screw 2104. The lead screw 2104 is rotated via driving force transmission gears 2102 and 2103, interlocked with normal or reverse rotation of a drive motor 2101. Further, since the recording head 2200 employs the one manufactured using the method as described above, recording operation with a high accuracy and at a high-speed can be carried out.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-026488 filed Feb. 9, 2010, which is hereby incorporated by reference herein in its entirety.

What is claimed is:

1. A manufacturing method for a liquid-discharge head substrate for discharging a liquid from a liquid discharge head, the liquid discharge head substrate including a substrate provided with an energy generating element that generates energy utilized for discharging liquid, a protective layer comprising insulation material provided on the energy generating element, and an adhesive layer provided to come into contact with a protective layer comprising noble metal, the manufacturing method comprising:

preparing the substrate provided with the adhesive layer having a surface comprising at least one of Ti, Ta, Ni, and Cr, or alloy comprising at least one of Ti, Ta, Ni, and Cr;

oxidizing a part of the surface of the adhesive layer by discharging electricity in an oxygen-containing gas; and providing the protective layer comprising noble metal on the adhesive layer, wherein the protective layer comprising noble metal is configured to contact the liquid during operation of the liquid discharge head.

2. The manufacturing method according to claim 1, wherein a percentage of a volume of oxygen contained in the gas to a volume of the gas is equal to or greater than 20%.

3. The manufacturing method according to claim 1, wherein inductively coupled plasma is used as a plasma source for the discharge.

4. The manufacturing method according to claim 1, further comprising:

preparing the substrate in which the protective layer comprising insulation material, the adhesive layer, and the protective layer comprising noble metal are layered in this order, so as to cover the energy generating element; and removing a part of the protective layer comprising noble metal by discharging electricity in the oxygen-containing gas;

wherein the oxidizing of the surface of the adhesive layer occurs after removing the part of the protective layer comprising noble metal.

5. The manufacturing method according to claim 1, wherein the adhesive layer comprises two layers consisting of a first adhesive layer and a second adhesive layer.

6. The manufacturing method according to claim 5, wherein the first adhesive layer is formed of Ti, and the second adhesive layer is formed of Ta.

7. The manufacturing method according to claim 1, wherein the protective layer comprising noble metal is formed of a material containing Ir or Ru.

8. The manufacturing method according to claim 1, wherein the protective layer comprising noble metal is configured such that, upon application of a voltage to the protective layer comprising noble metal while the noble metal layer is in contact with the liquid, at least a portion of the protective layer comprising noble metal dissolves in the liquid.

9. The manufacturing method according to claim 1, wherein the energy generating element provided with the substrate comprises an electrode wiring layer.

* * * * *